US008696496B2

(12) United States Patent
Walters

(10) Patent No.: US 8,696,496 B2
(45) Date of Patent: Apr. 15, 2014

(54) EXPERT GREENREADING TECHNIQUES

(76) Inventor: Andrew J. Walters, Duluth, GA (US)

( * ) Notice: Subject to any disclaimer, the term of this patent is extended or adjusted under 35 U.S.C. 154(b) by 432 days.

(21) Appl. No.: 13/008,447

(22) Filed: Jan. 18, 2011

(65) Prior Publication Data

US 2011/0177889 A1 Jul. 21, 2011

Related U.S. Application Data

(60) Provisional application No. 61/296,315, filed on Jan. 19, 2010.

(51) Int. Cl.
*A63B 69/36* (2006.01)

(52) U.S. Cl.
USPC ..... 473/409; 473/404

(58) Field of Classification Search
USPC ..... 473/241, 257, 268, 404, 405, 407, 409; 33/286, 289, 276, 277, 281, 282, 284, 33/285, 292
See application file for complete search history.

(56) References Cited

U.S. PATENT DOCUMENTS

| | | | | | |
|---|---|---|---|---|---|
| 1,635,857 | A * | 7/1927 | Murray | 33/353 |
| 4,005,870 | A * | 2/1977 | Grace et al. | 473/409 |
| 4,824,114 | A * | 4/1989 | Catalano | 473/251 |
| 4,927,151 | A * | 5/1990 | Ronnick | 473/241 |
| 5,290,035 | A | 3/1994 | Hannon et al. | |
| 5,415,408 | A * | 5/1995 | Livesay et al. | 473/238 |
| 5,431,391 | A * | 7/1995 | Tracey | 473/257 |
| 5,503,393 | A * | 4/1996 | Casperson | 473/404 |
| 5,893,804 | A * | 4/1999 | Pan | 473/240 |
| 5,957,782 | A * | 9/1999 | Madara | 473/226 |
| 6,770,000 | B2 * | 8/2004 | Shelley | 473/404 |
| 7,607,999 | B2 | 10/2009 | Green | |
| 2004/0053703 | A1 * | 3/2004 | Snyder | 473/243 |
| 2008/0009362 | A1 * | 1/2008 | Burns, Jr. | 473/293 |

* cited by examiner

*Primary Examiner* — Nini Legesse
(74) *Attorney, Agent, or Firm* — Eschweiler & Associates, LLC

(57) ABSTRACT

In order to reduce or eliminate bad green reads, the inventor has devised expert green reading techniques that allow a golfer to accurately and quickly read greens, thereby reducing scores and increasing enjoyment for the golfer. Rather than making a green read while being positioned behind the ball with respect to the cup as in conventional green reading techniques, in the disclosed expert green reading techniques a golfer takes a specific, precise, and consistent stance on or adjacent to a path between the ball and the cup.

5 Claims, 6 Drawing Sheets

200 While standing at the first position, hold a plumb determining device (e.g., a center-balanced putter) in front of the golfer to establish a true vertical axis via the plumb determining device Position the lower part of the true vertical axis (e.g., putter shaft) so it is aligned with the object on the straight ground line

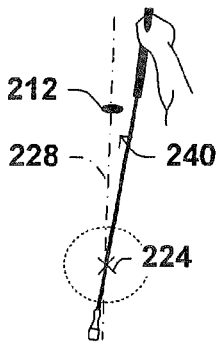

FIG. 7A

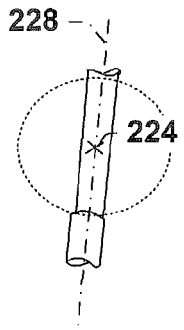

FIG. 7B

Evaluate angle/gap between true vertical axis and desired endpoint (e.g., cup). If the cup is left of the shaft, there's left break. If the cup is right of the shaft, there's right break. If shaft splits the cup, the golfer is on level ground.

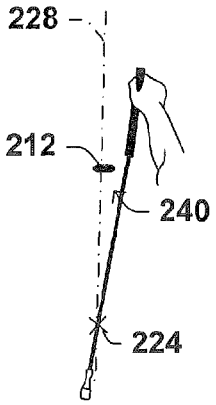

Left Break

FIG. 8A

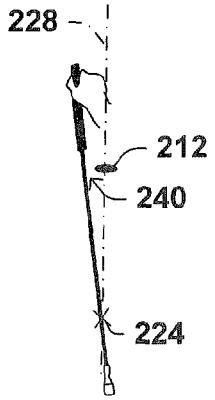

Right Break

FIG. 8B

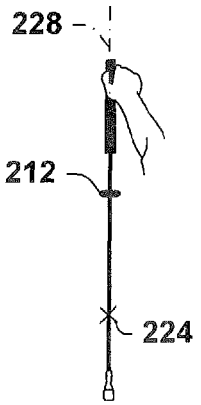

Straight

FIG. 8C

EXPERT GREENREADING TECHNIQUES

RELATED APPLICATIONS

This application claims priority to United States provisional patent application (Ser. No. 61/296,315) filed on Jan. 19, 2010, and entitled, "Expert Greenreading Techniques", the contents of which are incorporated herein in their entirety.

BACKGROUND

Golf is a precision club-and-ball sport, in which competing players ("golfers") use sets of clubs to attempt to hit their respective balls into a series of holes spread over a golf course. In stroke play, golfers can win by hitting their ball into all of the holes using the fewest number of hits ("strokes"). Other types of play, such as match play, also typically require one or more golfers to sink their ball in the fewest number of strokes to win.

Unlike most ball games, golf does not require a standardized playing area. Instead, the game is played on golf courses, each of which features a unique design that depends on the native geography, course layout, grasses and other materials that make up the course. Because each golf course is unique, golfers are constantly developing an ability to "read" the contours of the ground in an effort to determine precisely how their ball will travel for a given shot. This is particularly true when golfers are on the green close to the hole and want to "sink" a putt to allow them to move onto the next hole.

Until now, however, reading greens has been more of an art than a science—and a challenging art at that. For example, in 1999 Phil Mickelson lost the U.S. Open, one of the four majors, to Payne Stewart by a single stroke. After the tournament, "Bones" Mackay, Phil Mickelson's caddie for 18+ years, stated a regret stemming from a birdie attempt for Phil on the 17$^{th}$ green. On that birdie attempt, Bones studied the contour of the green and advised Phil that the putt was straight—in fact, however, it broke right. Mickelson missed, resulting in the one stroke loss to Payne Stewart. Phil Mickelson had to wait five more years before he was able to win a major (i.e., Phil won the Masters in 2004 by beating Ernie Els to get the "majors monkey" off his back). Golf history is replete with other examples of bad green reads.

In order to reduce or eliminate bad green reads, the inventor has devised expert green reading techniques that allow a golfer to quickly, confidently and accurately read a green, thereby reducing scores and increasing enjoyment for the golfer.

DESCRIPTION OF THE DRAWINGS

FIGS. 2-9 show a more detailed example of an expert green reading method consistent with the method of FIG. 1.

DETAILED DESCRIPTION

Figure 1:
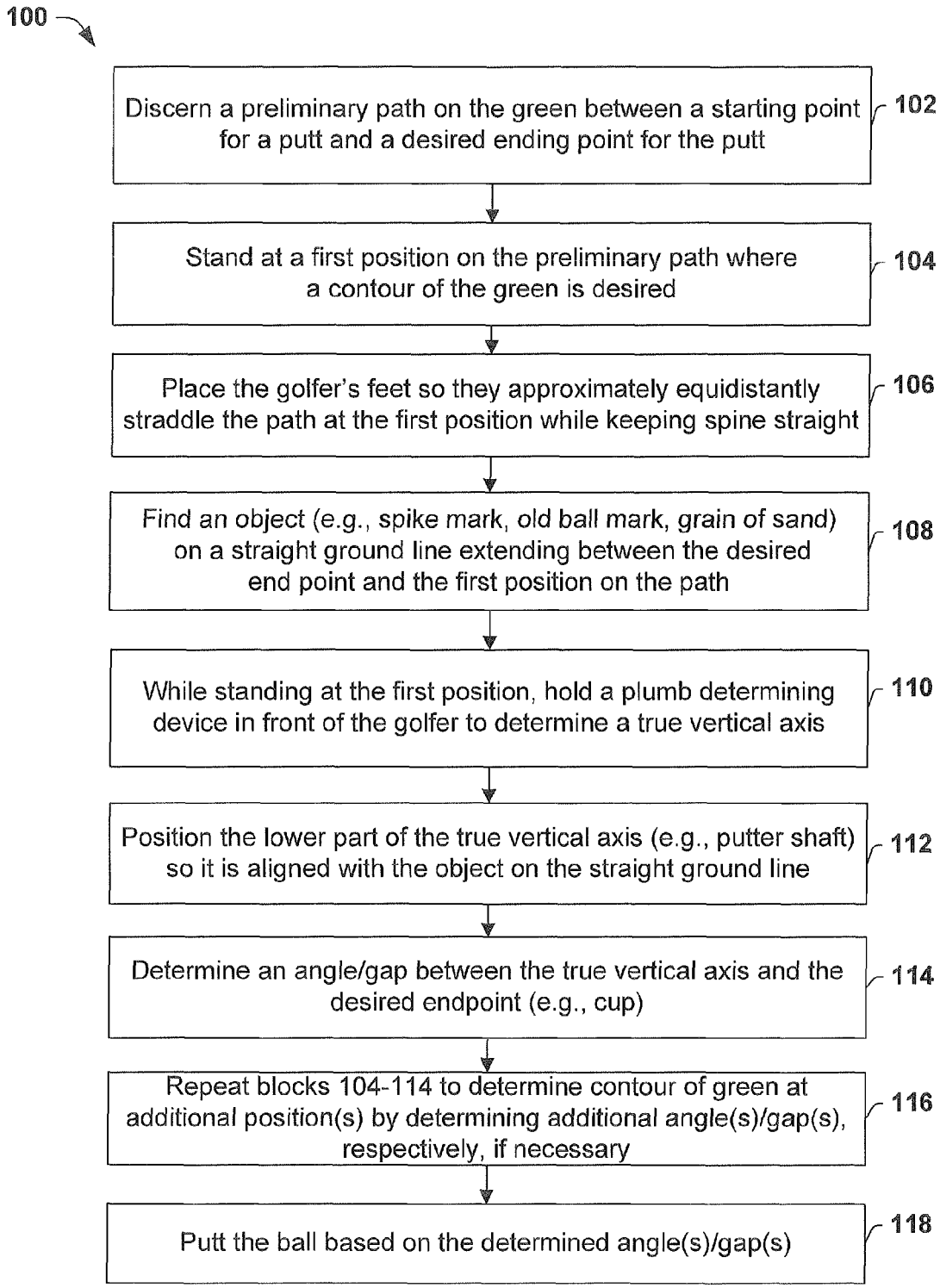
FIG. 1 illustrates a method of expert green reading in accordance with some embodiments of the present invention.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that the claimed subject matter may be practiced without these specific details.

FIG. 1 illustrates one example of an expert green reading method in accordance with some aspects of this disclosure. As will be appreciated in more detail below, rather than making a green read while being positioned behind the ball with respect to the cup as in conventional green reading techniques, the inventive techniques teach a golfer to take a specific, precise, and consistent stance on or near a path between the ball and the cup when making a green read. The method can be carried out by a golfer during competition or practice rounds on a golf course. Alternatively, an instructor, such as a golf pro or other teaching professional, can instruct one or more pupils to carry out the acts of the method 100 to train the pupils to putt more accurately.

FIGS. 2-8 illustrate an expert green reading method 200 consistent with the method of FIG. 1, and are now discussed below.

Figure 2:
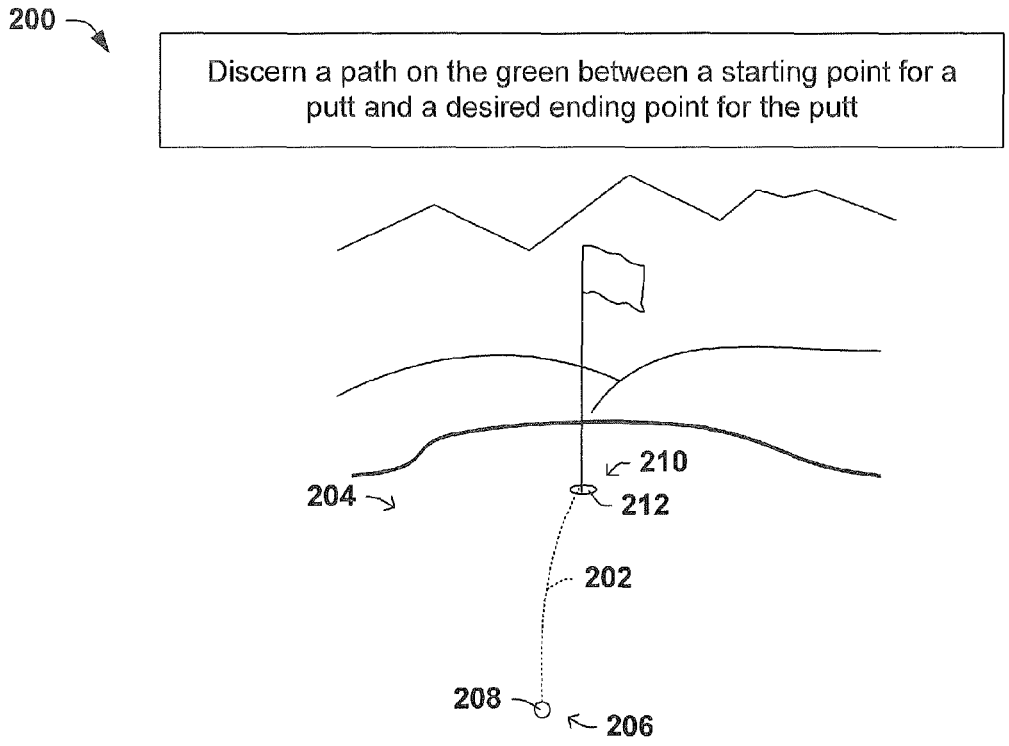

Referring now to FIG. 2, the expert green reading method 200 starts when a golfer discerns a preliminary path 202 on a green 204. The preliminary path 202 extends between a starting point 206 (e.g., where the golfer's ball 208 currently lies) and a desired ending point 210 (e.g., the cup 212). In some embodiments, the preliminary path 202 is a golfer's quick visual estimate as to a likely path followed by the ball 208 over the green 204 for a long putt, but in other embodiments the preliminary path 202 is simply a straight ground line between the ball 208 and cup 212. As will be appreciated by a person of ordinary skill in the art, while the method 200 is carried out, the golfer should attempt to avoid stepping on the preliminary path 202 (as well as expected putting paths for other golfers) to comply with standard golf etiquette. It will be appreciated that although the ending point is typically the cup itself, it can also be some other target on the green 204 where the golfer desires the ball 208 to stop.

Figure 3:
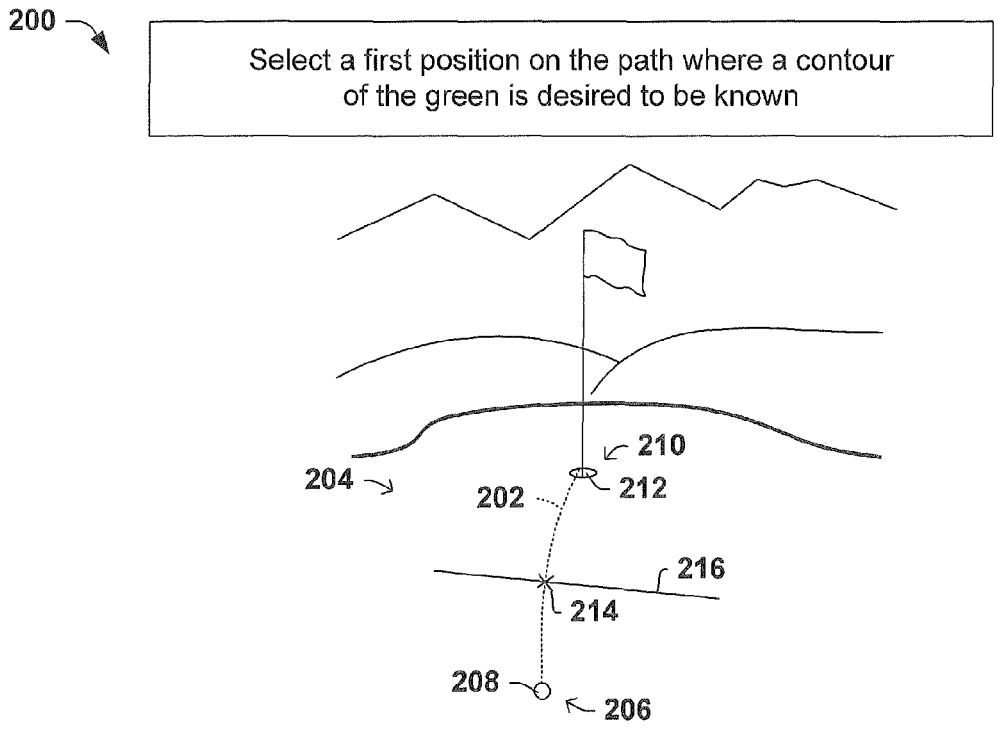

In FIG. 3, the golfer selects a first position 214 on the preliminary path 202 where a green contour 216 is desired to be known. In particular, the golfer often desires to determine this green contour 216 to evaluate how the golf ball 208, when putted, will travel over the first position 214. For example, the golfer often desires to know if the putted golf ball will break left or right, and by how much, when traveling over the first position 214.

Figure 4A:
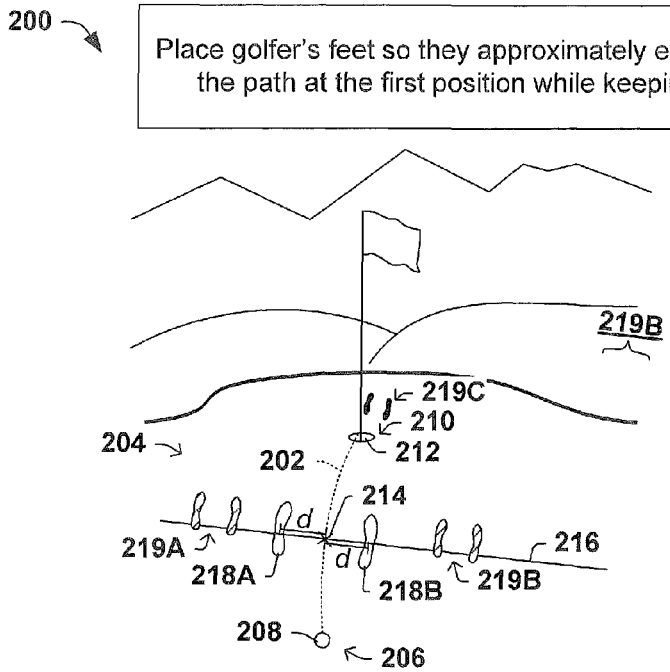
Figure 4B:
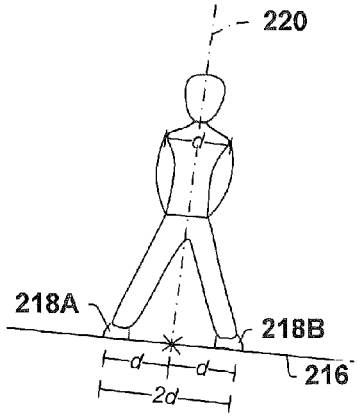

To determine the break at the first position 214 due to the green contour 216, the golfer can stand at the first position 214 by placing his or her feet 218A, 218B so they approximately equidistantly straddle the preliminary path 202 at the first position 214, as shown in FIGS. 4A-4B. For example, in the illustrated embodiment, the golfer has an approximate shoulder width, d, and the golfer's feet 218A, 218B are spaced apart by approximately twice shoulder width, 2 d. Alternatively, rather than straddling the preliminary path 202 at the first position 214, the golfer can stand adjacent to the preliminary path 202 as shown by 219A or 219B (e.g., the golfer can stand with both feet on one side of the preliminary path 202 but within a radius of approximately 6' of the preliminary path 202). The golfer could also stand past the hole on the preliminary path 202, for example at 219C, to evaluate the amount of break near the hole. Whatever, the case, while the golfer's feet 218A, 218B are equidistantly spaced about or adjacent to the preliminary path 202, the golfer locks his or her knees and straightens his or her spine and neck, thereby causing the golfer's spine and neck to lie along an axis 220 that is perpendicular to the contour 216 on which the golfer is standing.

Figure 5:
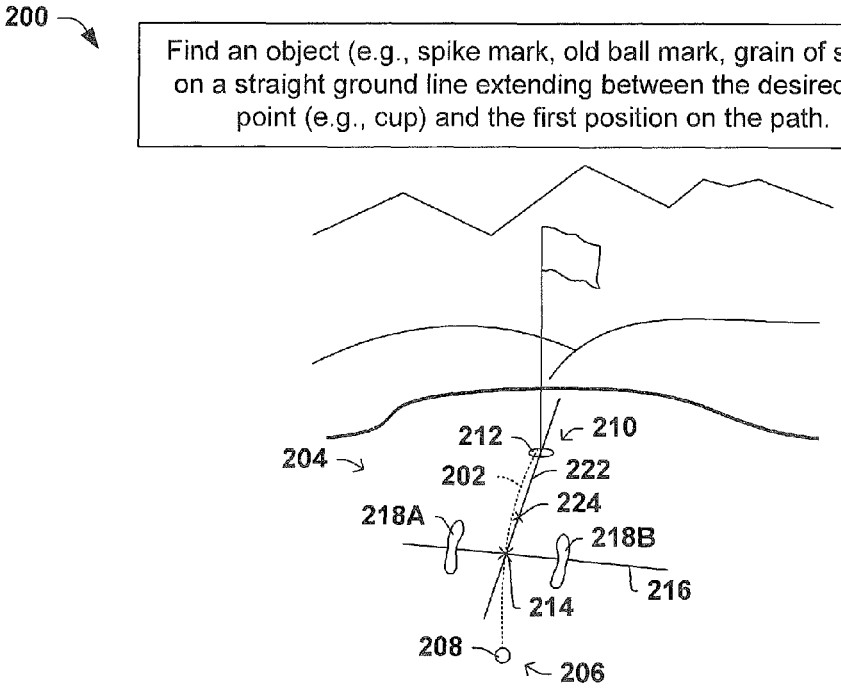

In FIG. 5, the golfer visualizes a straight ground line 222 on the green 204 which extends between the desired end point 212 and the first position 214. The golfer then finds an object 224 (e.g., spike mark, old ball mark, grain of sand—indicated by "x" 224 in FIG. 5) on this straight ground line 222. Typically, the object 224 lies between the midpoint of the path 222 (i.e., midpoint between the cup 212 and the first position 214) and the first position 214.

Figure 6A:
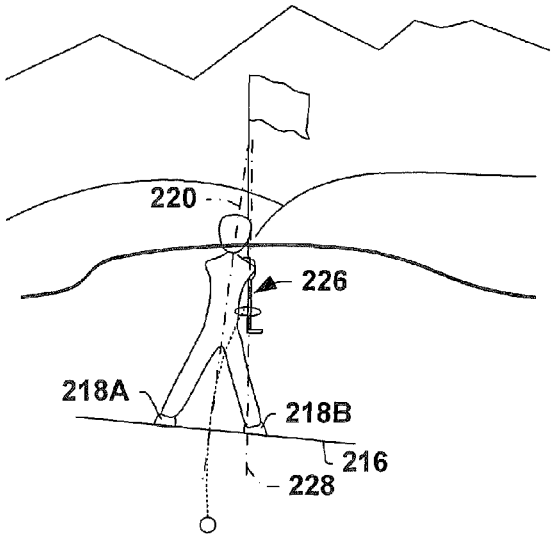
Figure 6B:
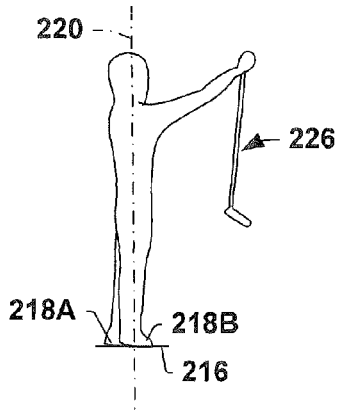
Figure 10:
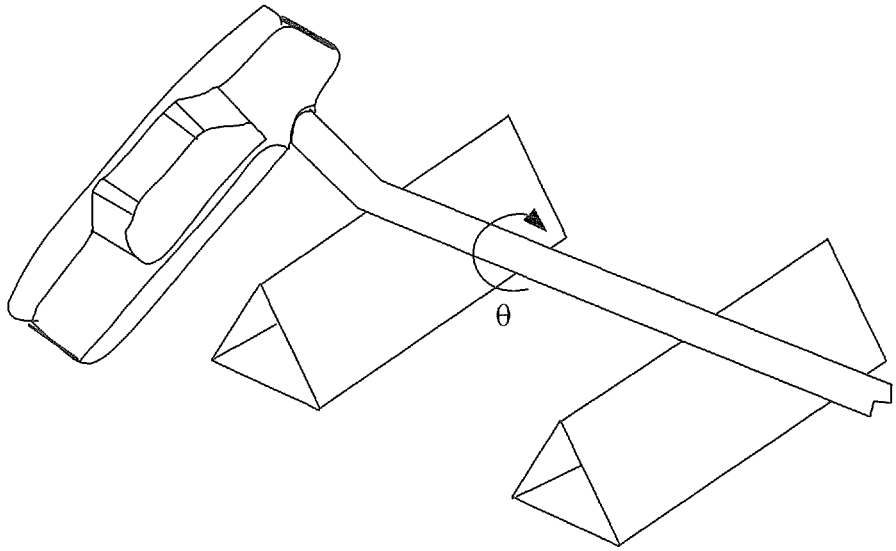
FIG. 10 shows an example of a balanced puffer that can be used as a plumb determining device in some embodiments.

In FIG. 6A-6B, while standing at the first position 214, the golfer holds a plumb determining device 226, such as a putter or other golf club, in front of the golfer to determine a true vertical axis 228. Depending on the slope of the green contour 216, the true vertical axis 228 can differ from the axis corresponding to the golfer's spine 220. In some embodiments, the plumb determining device 226 is a balanced putter, such as described by Hannon et al. in U.S. Pat. No. 5,290,035. As illustrated in FIG. 10, a balanced putter is characterized in that the putterhead's heel and toe will stay set when set to any angular position. In contrast, putters that are not "balanced" will tend to rotate back to a single angular position, which is the only angular position at which the non-balanced putter is balanced. This "balanced" behavior causes a shaft of a balanced putter to remain aligned to a true vertical axis no matter how the putter head is rotated while plumbed. Non balanced putters can be used to determine true vertical, but non-balanced putters often give a skewed-plumbline. Although a golfer could, in theory, mark a non-balanced putter with a mark to indicate the viewing position corresponding to true vertical, such as disclosed in U.S. Pat. No. 7,607,999 for example, such a marked putter would be non-USGA conforming because the USGA prohibits any surveying marks on putters. Hence, balanced putters are preferable in many instances.

Figure 6C:
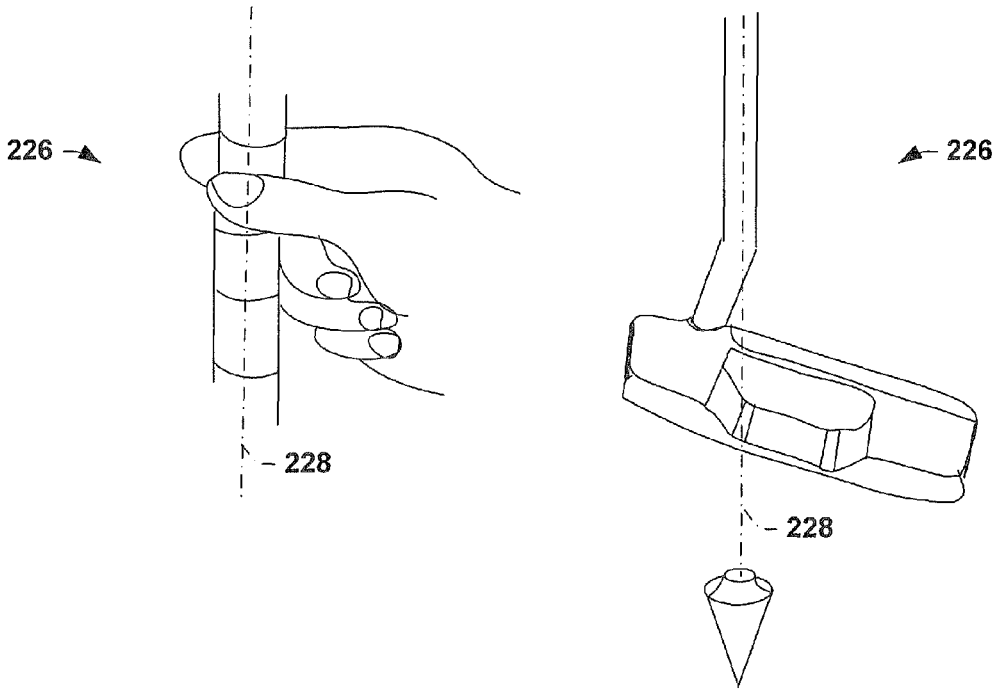

FIG. 6C shows one example of how to hold a putter to determine a true vertical axis 228. The putter is held at arm's length by lightly applying two fingers to the grip of the putter.

As shown in FIG. 7, when the plumb-determining device 226 aligned with the object 224 on the straight ground line 222, the plumb-determining device 226 is tuned to the true vertical angle 228, as viewed from the golfer's perspective. For example, when the plumb determining device 226 is a putter, the lower portion is the lower half of the shaft of the putter. An angle gap 240 can be formed between the true vertical angle 228 and the desired end point for the putt 212.

As shown in FIG. 8, the golfer can then evaluate an angle/gap 240 between the true vertical axis and the desired endpoint to determine the slope of the green contour 216. If the cup 212 is left of the true vertical axis 228 (FIG. 8A), there's left break. If the cup 212 is right of the true vertical axis 228 (FIG. 8B), there's right break. If true vertical axis 228 splits the cup 212 (FIG. 8C), the golfer is on level ground. The size of the angle/gap between the true vertical axis 228 and the cup 212 indicates the amount of break at the green contour 216 being evaluated. For example, a larger gap/angle indicates more break, while a smaller gap/angle indicates less break.

Figure 9:
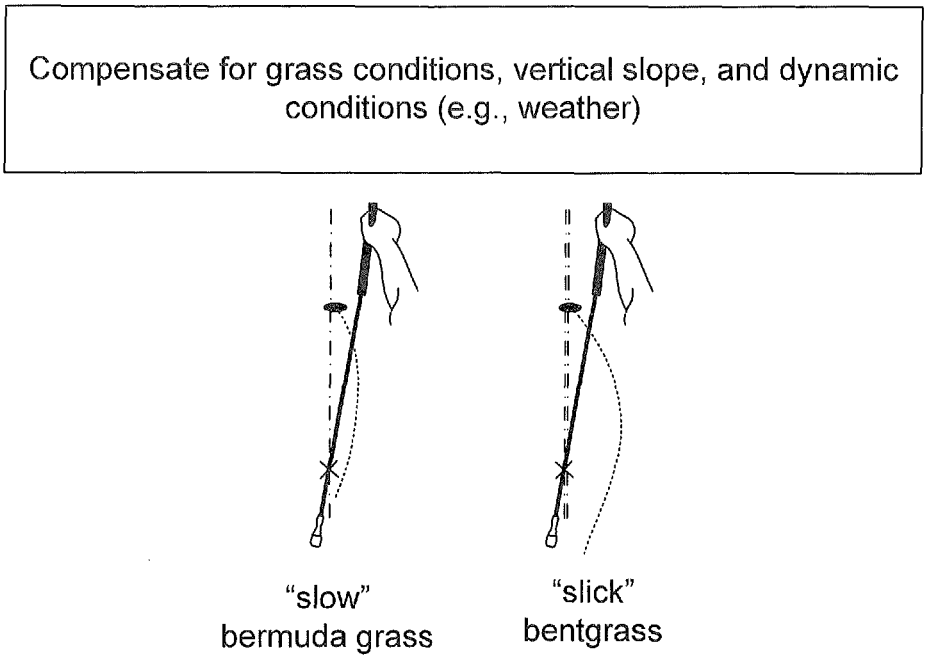

To make putting most accurate, the golfer should carry out calibration prior to starting a round (e.g., on the practice green prior to each round) to account for other factors. For example, by going through calibration, the golfer can better account for the type of grass on a particular course, the grass height, moisture conditions, and vertical slope among other factors. FIG. 9 shows two cases where an angle/gap between the cup 212 and true vertical axis 228 is the same (i.e., the slope of the ground contour 216 is the same). However, in these cases the amount of break in the put is different. The difference arises due to the fact that the putt on the left of FIG. 9 is on "slow" Bermuda grass and the putt on the right of FIG. 9 is on "slick" bent grass. Again, by calibrating the green reading method on a practice green before the round, a golfer can tune his green reads to account for such conditions, thereby increasing the accuracy of putts during a round.

It will be appreciated that, in some embodiments the methods may be carried out by an expert green reader who uses only one eye (e.g., a dominant eye, or a left or right eye) to carry out the methodology. In other embodiments, the expert green reader can use both eyes to carry out the methodology. Often, the expert green reader will always carry out the method using the same techniques, such as always using only the dominant eye to read the green for example.

The methods described herein may be realized and stored on a transitory or non-transitory computer readable medium (e.g., ROM, RAM, CDs, DVDs, volatile computer memory, non-volatile computer memory) as well as audio visual medium (e.g., cassettes, VHS tapes) or printed materials. In some embodiments, these articles of manufacture allow the method to be efficiently disseminated and sold to the public at large, thereby helping millions of golfers to improve their putting techniques. The substance of these methods may also be disseminated over the Internet in the form of audio and/or visual files. For example, a golf instructor can be video recorded, and the audio visual content contained the video can be stored on a DVD and distributed to customers buying the expert green reading method, or can be streamed to customers over the Internet.

Although the disclosure has been shown and described with respect to one or more implementations, equivalent alterations and modifications will occur to others skilled in the art based upon a reading and understanding of this specification and the annexed drawings. For example, although the method is typically most advantageous on a green, the methods in accordance with this disclosure can also be used on other surfaces on a golf course in some instances, such as on a fairway, a "hard-pan" surface, or on old-style courses where significant ball roll may be encountered. It will also be appreciated that identifiers such as "first" and "second" do not imply any type of ordering or placement with respect to other elements; but rather "first" and "second" and other similar identifiers are just generic identifiers. The disclosure includes all such modifications and alterations and is limited only by the scope of the following claims. In addition, while a particular feature of the disclosure may have been disclosed with respect to only one of several implementations, such feature may be combined with one or more other features of the other implementations as may be desired and advantageous for any given or particular application.

In addition, the articles "a" and "an" as used in this application and the appended claims are to be construed to mean "one or more". Furthermore, to the extent that the terms "includes", "having", "has", "with", or variants thereof are used in either the detailed description or the claims, such terms are intended to be inclusive in a manner similar to the term "comprising."

What is claimed is:

1. A method of instructing a golfer how to accurately read a green, comprising:

instructing the golfer to discern a path for a golf ball on the green, where the path extends between a starting point for a putt and a desired ending point for the putt;

instructing the golfer to stand at a first position on the path where a green contour is desired to be known, and to place the golfer's feet so they approximately equidistantly straddle the path at the first position and to stand straight;

instructing the golfer to, while standing at the first position, identify an object disposed on a straight ground line extending between the desired ending point for the putt and the first position;

instructing the golfer to, while standing at the first position, hold a plumb determining device in front of the golfer to determine a true vertical axis and such that a lower portion of the true vertical axis is aligned with the object;

instructing the golfer to, while standing at the first position, evaluate a first angle or gap formed between the true vertical axis and the desired ending point; and instructing the golfer to putt the ball based on the first angle.

2. The method of claim 1, wherein the plumb determining device is a center balanced putter.

3. The method of claim 1, where the golfer is instructed to place his or her feet to straddle the path at a distance equal to approximately twice the golfer's shoulder width.

4. The method of claim 1, further comprising:

instructing the golfer to avoid stepping on the path while performing the method.

5. The method of claim 1, further comprising:

instructing the golfer to stand at a second position on the path where a second contour of the green is desired and to place the golfer's feet so they approximately equidistantly straddle the path at the second position;

instructing the golfer to, while standing at the second position, hold the center-balanced putter in front of the golfer so the shaft of the putter is aligned along the true vertical axis;

instructing the golfer to, while standing at the second position, evaluate a second angle or gap formed between the true vertical axis and the desired ending point; and instructing the golfer to putt the ball based on both the first angle and the second angle.

* * * * *